United States Patent [19]

Black

[11] 4,065,229

[45] Dec. 27, 1977

[54] VARIABLE CAPACITY RADIAL-4 COMPRESSOR

[75] Inventor: Dennis A. Black, Dayton, Ohio

[73] Assignee: General Motors Corporation, Detroit, Mich.

[21] Appl. No.: 728,545

[22] Filed: Oct. 1, 1976

[51] Int. Cl.[2] ..... F04B 1/10; F04B 49/00

[52] U.S. Cl. ..... 417/270

[58] Field of Search ..... 91/6.5; 417/270, 273, 417/295

[56] References Cited

U.S. PATENT DOCUMENTS

| | | | |
|---|---|---|---|
| 2,545,774 | 3/1951 | Griswold | 417/273 |
| 3,050,004 | 8/1962 | Heintzmann | 417/295 |
| 3,151,569 | 10/1964 | Muller | 417/270 |
| 3,200,761 | 8/1965 | Firth et al. | 91/6.5 |
| 3,202,106 | 8/1965 | Firth et al. | 91/6.5 |
| 3,418,937 | 12/1968 | Cardillo | 417/273 |
| 3,434,428 | 3/1969 | Liles | 417/270 |
| 3,924,968 | 12/1975 | Gaines | 91/6.5 |

*Primary Examiner*—William L. Freeh
*Attorney, Agent, or Firm*—Edward P. Barthel

[57] ABSTRACT

A compact variable capacity radial refrigerant compressor suitable for use in automotive refrigeration systems includes cast cylinder housing having cross bores and intake and discharge chambers formed therein which communicate with a central suction cavity. One end of the compressor housing has a modulator port surface coaxial with the unit axis while each cylinder side wall has port means therethrough for conveying gas from the cylinder compression chamber to the suction cavity with the port means having their exits located in the modulator surface. A variable capacity modulator plate is movably mounted in the recess for selectively opening and closing the port means by the rotary adjustment of the ring relative to the port means, thereby regulating suction bypass through the port means to selectively control the compressor capacity to match demand to maximize pumping efficiency and minimize horsepower requirements.

4 Claims, 6 Drawing Figures

VARIABLE CAPACITY RADIAL-4 COMPRESSOR

This invention relates to radial compressors and more particularly to a compact automotive refrigerant variable capacity radial refrigerant compressor of the type including a rigid cylinder housing having oppositely extending pairs of cross bores together with intake and exhaust chambers.

The advantages of radial compressors are well recognized in the art. Such compressors have found a ready acceptance in the automotive air conditioning field wherein limited space within vehicle engine compartments necessarily requires use of accessory components occupying a minimum of space. An example of a highly successful radial compressor is found in U.S. Pat. No. 3,924,968, issued to Marvin E. Gaines and Robert L. Swadner, and assigned to the assignee of the present application. The present invention resides in an improved radial compressor of the aforementioned type comprising variable displacement means to selectively control compressor capacity to match demand in a manner conducive to maximizing pumping efficiency and minimizing energy requirements.

An object of the present invention is the provision of a variable capacity radial compressor having a floating control plate with ports which may be angularly oriented to register with ports in the housing communicating with the compressor cross bores to reduce horsepower requirements of the compressor.

Another object of this invention is the provision of a compact variable capacity radial compressor having control exhaust ports in the cylinder bore walls which communicate with the suction inlet chamber such that a circular recess formed in one end of the compressor housing having a modulator port surface coaxial with the compressor unit axis with the port means have their exits located in the modulator surface, whereby a modulator apertured ring is movably mounted in the recess for selectively opening and closing the port means by registering certain of the ring apertures relative to the housing port means.

A still further object of the present invention is the provision of a compact radial variable capacity refrigerant compressor having a modulator ring mounted for selectively opening and closing port means in each of the cylinder bores by virtue of the modulator ring having a plurality of slots therein of varying arcuate extent operative to register in one manner respectively with the housing port means of each bore on rotation of the ring to a first position, whereby each of the housing port means is open allowing gas to flow from the compressor chamber of each bore to the suction cavity so that a minimum of pumping work is done on the gas; said modulator ring operative to register in another manner respectively with the housing port means of each bore upon rotation of said ring in the opposite direction through a successive predetermined angular distance to a plurality of successive positions sequentially opening the housing port means one bore at a time so that the pumping capacity of the compressor is reduced by one compression chamber for each of the successive positions.

Further objects and advantages of the present invention will be apparent from the following description, reference being had to the accompanying drawings, wherein a preferred embodiment of the present invention is clearly shown.

Figure 1:
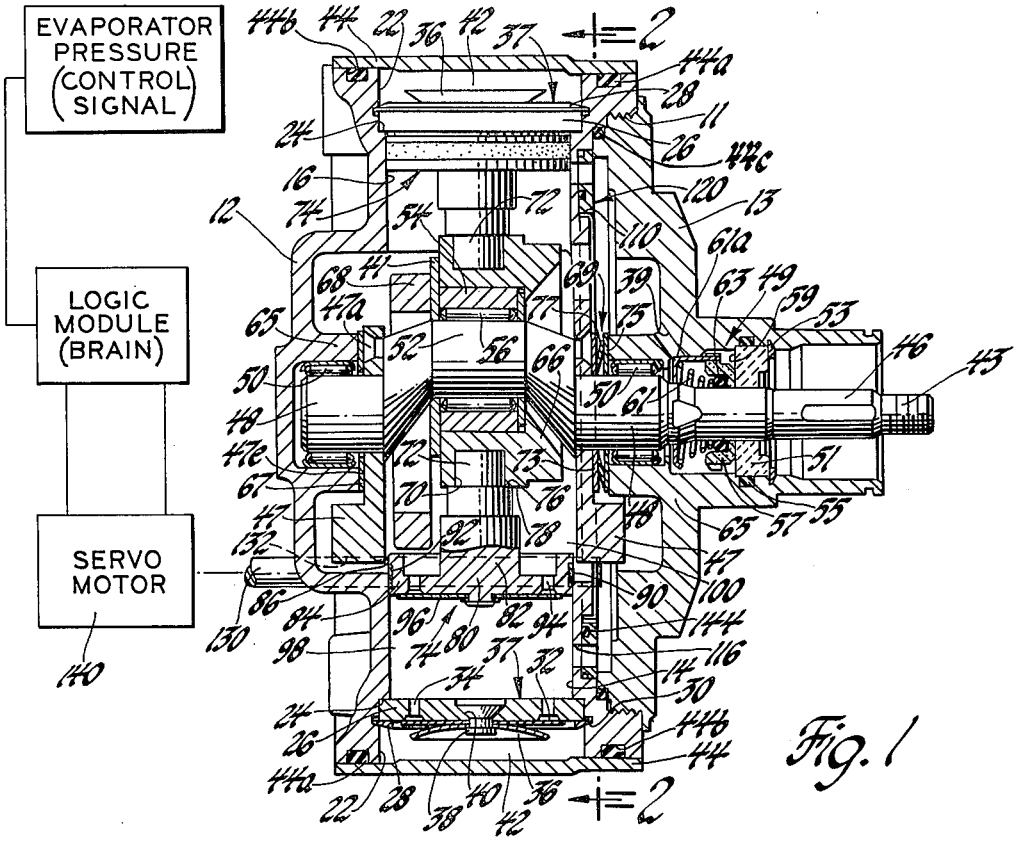
FIG. 1 is a view in vertical section taken on an irregular plane through a radial compressor incorporating the present invention.
Figure 6:
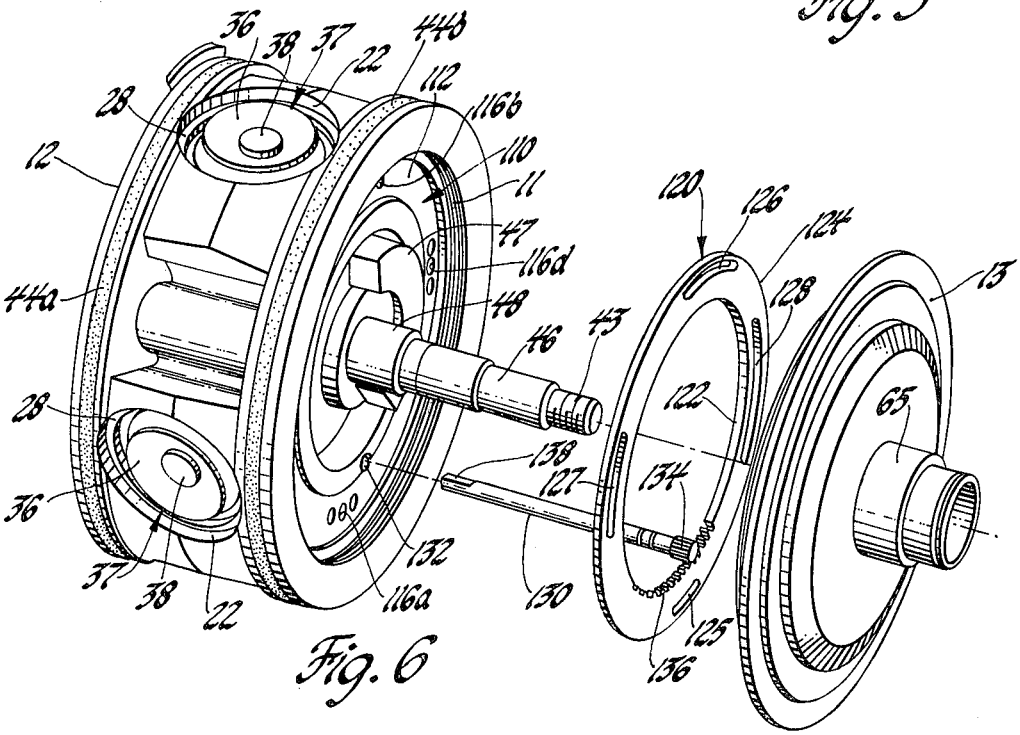
FIG. 6 is an exploded perspective view of the radial compressor of the present invention.

Referring now to the drawings, a radial compressor having features of the subject invention is shown in FIGS. 1 and 6. Basically, the subject invention is a modification of the compressor assembly described in the aforementioned Gaines et al. U.S. Pat. No. 3,924,968 issued Nov. 19, 1973, the disclosure of which is incorporated by reference into the description of this invention.

Figure 2:
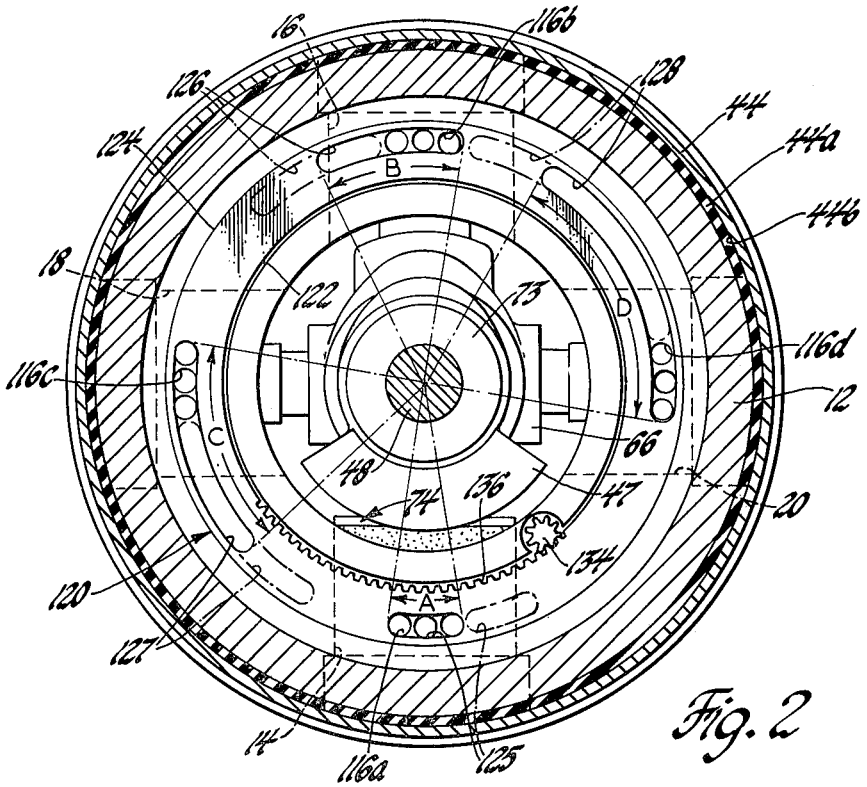
FIG. 2 is an enlarged vertical cross-sectional view taken on line 2—2 of FIG. 1.
Figure 3:
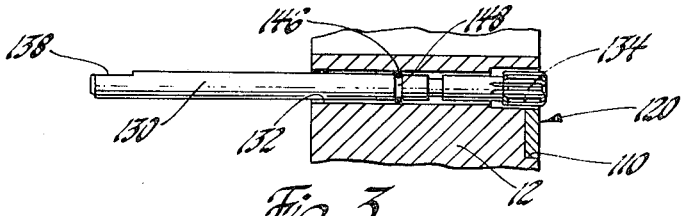
FIG. 3 is an enlarged fragmentary sectional view of the control rod of the present invention.

The subject compressor includes a rigid cast cylinder housing 12 enclosed by a cylinder head 13 removably secured to the housing such as by thread means 11, with oppositely extending cross bores 14 and 16 on a first axis of the housing and a second pair of cross bores 18 and 20 on another axis of the housing normal to the first axis as best shown in FIG. 2. Each of the cross bores terminate in diametrically enlarged counterbore 22 connecting with the aforementioned bores at a flange or shoulder 24. A valve plate 26 is positioned against the flange 24 and is retained by a snap ring 28 received in a groove 30 in the enlarged bore 22. An annular discharge reed plate 32 controls flow through a series of circumferentially spaced discharge apertures 34 and is retained by a plate 36, the valve plate assembly 37 or discharge valve means being secured together by a rivet 38 in a central aperture 40 in the valve plate 26. The reed plate 32 controls flow of pressurized gas into a discharge chamber 42. The cylinder housing is circular in form and is enclosed on its outer periphery by a cylindrical band 44 enclosing the discharge chamber 42, the band 44 (not shown in FIG. 6) being retained by a plurality of pins (not shown) in housing 12. Annular seals **44*a* are received in housing grooves 44*b*, which with O-ring seal 44*c* provide a fluid-tight seal arrangement for discharge chamber 42**.

The compressor is driven from the threaded end 43 of a shaft 46 which includes spaced enlarged bearing portions 48 and supported for rotation in housing 12 by main bearing assemblies 50 in communication with a central suction space or inlet chamber 100 via lubrication bleed passageways 39. The shaft 46 also includes an eccentric portion 52 having a slider block 54 mounted thereon for relative rotation between the shaft and the block via a plurality of separate elongated needle bearings 56 which are retained against axial movement relative to the eccentric portion 52 by needle retainers 41. As shown and described in the mentioned Ganes et al. patent, the slider block 54 includes surfaces which engage surfaces such as 62, for example, of yoke assemblies 66 and 68.

The shaft 46 also supports a pair of counterweights 47 and engages a fluid seal assembly 49 as illustrated in FIG. 1. The seal assembly includes a ceramic ring 51 retained by snap ring 53, the ceramic ring being sealed at its outer periphery by O-ring 55. A carbon or like material sealing ring 57 is biased in engagement with face 59 of the ceramic ring 51 by a spring 61 positioned in sheet metal cup 61*a*. An O-ring 63 seals the inner periphery of the carbon sealing ring 57 with the outer surface of shaft 46.

The cylindrical housing 12 and cylinder head 13 each include inwardly extending annular flanges 65 which receive the previously described shaft portions 48 and their associated bearing assemblies 50. The counterweights 47 are pivotally mounted to the shaft eccentric 52 by a rivet 47*a* extending through an aperture in the eccentric. A thrust bearing washer 67 is provided between an annular flange 65 of housing 12 and the surface 47*e* of its associated counterweight 47. The thrust bearing assembly 69 comprises a pair of washers 73 and 75 which are biased axially apart by Belleville spring 77 so that the eccentric 52 of shaft 46 is centrally positioned relative to the cross bores 14, 16, 18 and 20.

The yoke assemblies 66 and 68 are machined to include cavities 70 each receiving a reduced stem portion 72 of piston assembly 74. The stem portion 72 is press fitted within the cavity 70 to form a rigid connection between the respective yokes and the piston assemblies. The piston assembly 74 can be formed to include a shoulder 76 engaging outer surface 78 of the yoke assemblies to aid in the stability of the connection. The piston assemblies 74 each comprise a diametrically enlarged central portion 80 which terminates in an integral cup portion 82 having relatively short skirt portion 84 providing an outer surface 86 engaging cylinder bore 14 of the cylinder housing 12. The outer surface 86 of the piston assembly 74 contains a relatively wide groove 90 receiving in the preferred embodiment, a matched Teflon sealing ring 92 providing a fluid type seal between the outer surface 86 of the piston and the wall of cylinder bore 14.

The Teflon ring 92 is initially in the form of a flat washer described in the mentioned Gaines et al. patent. The piston assembly also includes circumferentially spaced inlet apertures 94 which are normally closed by a suction reed plate 96 or suction valve means operative to regulate flow of gas into its associated compression chamber 98 from the inlet chamber 100.

In normal full capacity operation rotation of shaft 46 results in reciprocating movement of the slider block 54 along two axes which are normal to one another so as to provide reciprocation of the piston assembly 74 within their respective cross bores 14, 16, 18 and 20. Movement of one of the piston assemblies 74 within its respective cross bore toward the center of the cylinder housing causes the gas to open the suction reed plate 96 forcing refrigerant from inlet chamber 100 through apertures 94 into compression chamber 98 while at the other end of the yoke assembly, the piston assembly being extended compresses refrigerant in chamber 98 opening discharge reed plate 32 so that the pressurized refrigerant flow through apertures 34 into discharge chamber 42 for supply to the system through port means as shown in the Gaines et al. patent. An inlet port (not shown) is provided for entrance of refrigerant into inlet chamber 100 from the vehicle air conditioning system for compression thereof and recirculation to the system for expansion and continuous recycling.

In accordance with the present invention the front face of the housing has machined therein a circular recess 110 having a modular port surface 112 concentric with the unit rotational axis of shaft 46. Each cylinder cross bore side wall is provided with housing outlet port means extending therethrough for conveying gas from each compression chamber 98 to the compressor central suction inlet space or chamber 100. As best seen in FIGS. 1 and 6, the housing port means in the disclosed embodiment are in the form of a plurality or grouping of circular ports arranged in opposed pairs 116*a* and 116*b* for cross bores 14 and 16 respectively and opposed pairs 116*c* and 116*d* for cross bores 18 and 20, respectively. In the form shown each group consists of three tangentially aligned ports for its associated cross bore. The exit ports 116*a*–116*d* are positioned such that their exits are located in the modular surface 112 with the opposed ports 116*a* and 116*b* aligned on first axis 117 of cross bores 14 and 16 and opposed ports 116*c* and 116*d* aligned on second axis 118 of cross bores 18 and 20.

As best seen in FIGS. 2 and 6, modulator means in the form of a modulator ring, generally indicated at 120, is mounted or located in the recess 110 so as to be slidable or rotatable therein. The face of the ring provides an annular surface defined between the inner and outer circular edges 122 and 124. The ring 120 has a plurality of variable sized arcuate slots therein providing valve port means. In the disclosed form four arcuate slots or valve ports 125, 126, 127 and 128 are provided with which the housing cylinder exit ports 116*a*–116*d* are positioned to register during selected times upon predetermined rotation of the ring 120.

As seen in FIGS. 1 and 6, the angular orientation of the ring 120 is controlled by adjustment or control means. In the form shown the control means is a rod member 130 which extends through a bore 132 in the back end of the housing. Rod 130 has pinion gears or teeth 134 formed on its inner end arranged to mesh with complementary gear teeth 136 formed as an arcuate rack of about 90° extent on the inner periphery 122 of the ring. The rod 130 may be rotatably adjustable manually by means of a suitable tool engaging flat portion 138 or automatically as by an appropriate hydraulic servo motor means, for example, indicated schematically at 140 in FIG. 1. The servo motor means could be made responsive to suitable indicia such as a pressure signal from the evaporator to a hydraulic control valve. In this way a control or logic module could regulate the energy consumption of an automotive air conditioning system by the varying output of the compressor to match the cooling requirements of the car.

As shown in FIG. 2, the four arcuate valve ports or slots 125–128 are of varying size by being formed in increasing arcuate lengths with arcuate port 125 having the smallest or minimum arcuate length, the opposed port 127 the third largest arcuate length, the port 126 the second largest and the port 128 the largest or maximum arcuate length. In the disclosed form the arcuate port 125 intercepts an angle A, i.e. extends between radii disposed at an angle of about 17° . In like manner the port 126 intercepts an angle B of about 35°, the port 127 intercepts an angle C of about 52° and the port 128 intercepts an angle D of about 68°.

The arcuate ports or slots 125–128 of ring 120 are formed on the same radius as that of the circular housing ports 116, thus assuring registration of the ring arcuate ports 125–128 and the housing exit ports 116 upon rotation of the ring through predetermined angles.

When the ring is rotated to its full line position of FIG. 2 the housing ports 116*a* of bore 114 are all in registry with arcuate port 125, the ports 116*b* of bore 16 are all in registry with arcuate port 126, the ports 116*c* of bore 18 are all in registry with arcuate port 127, and the ports 116*d* of bore 20 are all in registry with arcuate port 128. This position is achieved by virtue of rod pinion 134 having engaged the end tooth of ring gear tooth rack 136 rotating ring 120 to its furthest counterclockwise position. In this first position, wherein each set of the housing ports 116*a*–116*d* are in registry with their associated arcuate slot, the arrangement allows gas to flow from the compression chamber of each bore 14, 16, 18 and 20 to the compressor suction cavity so that a minimum of pumping work is done on the gas.

When the ring 120 is rotated in a counterclockwise direction from the full line position to the dotted line position of FIG. 2, the ring is disposed to close each set of the exit ports 116*a*–116*d* so that the compressor pumps at maximum capacity. It will be noted that the amount of counterclockwise rotation of the ring 120 required for this mode of operation is approximately 17° or the angular extent of arcuate port 125. Continued counterclockwise rotation of modulator ring 120 to its full line position of FIG. 4 will position the largest arcuate port or slot 128 at a location wherein the set of exit ports 116*b* are uncovered while the remaining sets of exit ports 116*a*, 116*c* and 116*d* are closed off or sealed, thus opening the compressor bore 116 so that the pumping capacity of the compressor is effectively reduced by one compression chamber.

Figure 4:
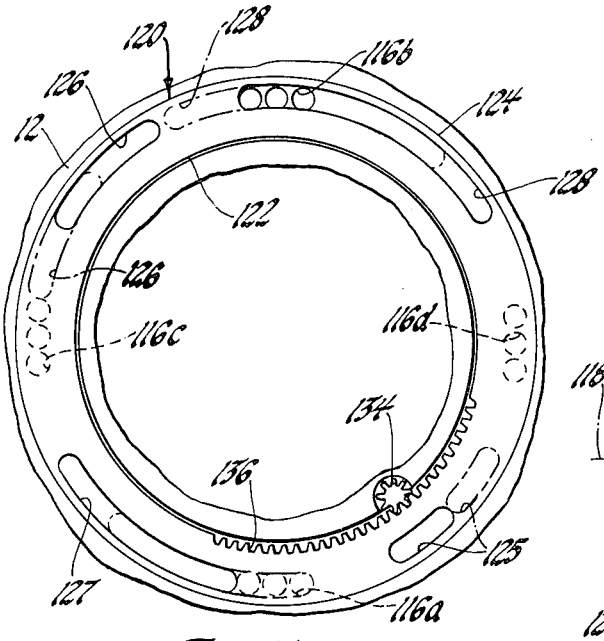
FIG. 4 is a fragmentary elevational view of the capacity adjustment plate of the present invention in its position wherein arcuate slots are positioned to permit the housing port means of one bore allowing gas to flow from the bore to the suction cavity.
Figure 5:
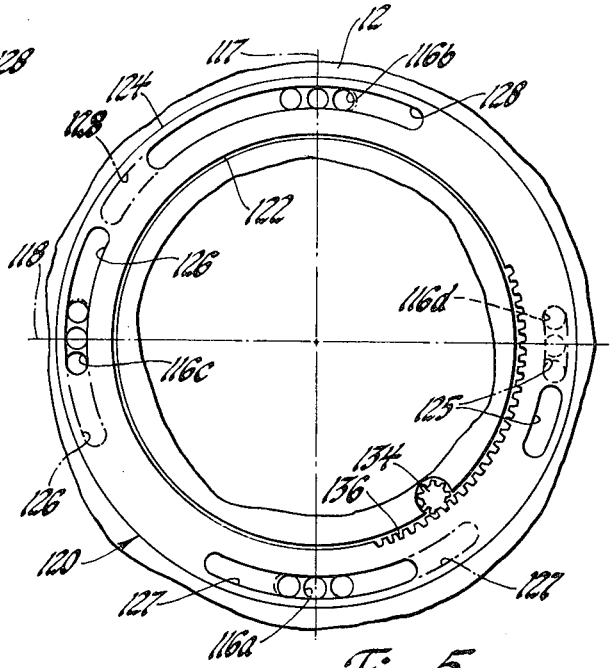
FIG. 5 is a view similar to FIG. 4, showing the capacity adjustment plate rotated to a position where each of the port cylinder bore port means are open allowing gas to flow from all four compression chambers to the suction cavity so that a minimum of pumping work is done on the gas.

Still further counterclockwise rotation of the modulator ring 120 to its dashed line position of FIG. 4 will result in the exit ports 116*b* remaining open while the opposed exit ports 116*a* of bore 14 are uncovered with opposed exit ports 116*c* and 116*d* remaining sealed, thus opening the bore 14 and causing the pumping capacity of the compressor to be reduced by two compression chambers. In a similar manner further counterclockwise rotation of ring 120 to its full line position of FIG. 5 results in the exit ports 116*a* and 116*b* remaining uncovered, while in addition the exit ports 116*c* of bore 18 are aligned with arcuate port 127 so as to be uncovered with the exit ports 116*d* held sealed thus opening the compression chamber of bore 18 causing the pumping capacity of the compressor to be reduced by three compression chambers. Lastly, counterclockwise rotation of the ring to its dashed line position of FIG. 5 results in the exit ports 116*d* being opened along with exit ports 116*a*, 116*b* and 116*c* whereby the compressor pumps at minimum capacity as described above. In this way the modulator ring is operative to register in a third manner with the housing exit ports of each bore upon rotation of the ring in a counterclockwise direction through successive predetermined angular distances to four successive positions sequentially opening the housing ports one bore at a time so that the pumping capacity of the compressor is reduced by about one fourth of each of the four successive positions.

It will be noted in FIG. 1 that an O-ring seal 144 is provided in an annular recess as the undersurface of modulator ring 120 to insure the sealed closure of the exit ports. Further, the control rod 130 has an O-ring seal 146 in annular groove 148 to provide a gas seal for the bore 132.

While the embodiment of the present invention as herein disclosed constitutes a preferred form, it is to be understood that other forms might be adopted.

I claim:

1. A radial compressor of the type including a cylinder housing having a unit axis and cross bores including cylinder walls therein along axes normal to each other forming compression chambers, the axes of said cylinder bores intersecting in a common transverse plane diametrical to said cross bores; a drive shaft on said unit axis rotatably mounted in the closed ends of said housing with said unit axis normal to said transverse plane at the intersection of said cross bore axes, a piston slidable in each of said bores, means forming inlet and outlet valves for said compression chambers, means in said housing operatively related to the pistons to reciprocate the pistons in said bores as said shaft is rotated, said cylinder housing being formed to include suction and discharge cavities, wherein the improvement comprises a circular recess being formed in one end of said housing having a modulator port surface coaxial with said unit axis; each cylinder side wall having housing port means therethrough for conveying gas from said bores to said suction cavity, said housing port means having their exits located in said modulator surface, a modulator ring being mounted in said recess for selectively opening and closing said port means by the rotary adjustment of the ring relative to said port means, means for rotating said ring in either direction to provide said rotary adjustment for controlling the effective output of said compressor, said modulator ring having a plurality of openings therein of varying size and operative to register in one manner respectively with the housing port means of each bore upon rotation of said ring to a first position, whereby each of the housing port means is open allowing gas to flow from the compression chamber of each bore to said suction cavity so that a minimum of pumping work is done on the gas, and said modulator ring openings operative to register in a second manner respectively with the housing port means of each bore upon rotation of said ring in one direction a predetermined angular distance to a second position, whereby said ring closes each of said port means so that said compressor pumps at maximum capacity.

2. A radial compressor of the type including a cylinder housing having a unit axis and cross bores including cylinder walls therein along axes normal to each other forming compression chambers, the axes of said cylinder bores intersecting in a common transverse plane diametrical to said cross bores; a drive shaft on said unit axis rotatably mounted in the closed ends of said housing with said unit axis normal to said transverse plane at the intersection of said cross bore axes, a piston slidable in each of said bores, means forming inlet and outlet valves for said compression chambers, means in said housing operatively related to the pistons to reciprocate the pistons in said bores as said shaft is rotated, said cylinder housing being formed to include suction and discharge cavities, wherein the improvement comprises a circular recess being formed in one end of said housing having a modulator port surface coaxial with said unit axis; each cylinder side wall having housing port means therethrough for conveying gas from said bores to said suction cavity, said housing port means having their exits located in said modulator surface, a modulator ring being mounted in said recess for selectively opening and closing said port means by the rotary adjustment of the ring relative to said port means, means for rotating said ring in either direction to provide said rotary adjustment for controlling the effective output of said compressor, said modulator ring having a plurality of slots therein of varying arcuate extent, said modulator ring slots operative to register in a manner respectively with the housing port means of each bore upon rotation of said ring through successive predetermined angular distances to a plurality of successive positions sequentially opening the housing port means one bore at a time so that the pumping capacity of said compressor is reduced by one compression chamber for each of the successive positions.

3. A radial compressor of the type including a cylinder housing having a unit axis and cross bores including cylinder walls therein along axes normal to each other forming compression chambers, the axes of said cylinder bores intersecting in a common transverse plane diametrical to said cross bores; a drive shaft on said unit axis rotatably mounted in the closed ends of said housing with said unit axis normal to said transverse plane at the intersection of said cross bore axes, a piston slidable in each of said bores, means forming inlet and outlet valves for said compression chambers, means in said housing operatively related to the pistons to reciprocate the pistons in said bores as said shaft is rotated, said cylinder housing being formed to include suction and discharge cavities, wherein the improvement comprises a circular recess being formed in one end of said housing having a modulator port surface coaxial with said unit axis; each cylinder side wall having housing port means therethrough for conveying gas from said bores to said suction cavity, said housing port means having their exits located in said modulator surface, a modulator ring being mounted in said recess for selectively opening and closing said port means by the rotary adjustment of the ring relative to said port means, means for rotating said ring in either direction to provide said rotary adjustment for controlling the effective output of said compressor, said modulator ring having a plurality of slots therein of varying arcuate extent and operative to register in some manner respectively with the housing port means of each bore upon rotation of said ring to a first position, whereby each of the housing port means is open allowing gas to flow from the compression chamber of each bore to said suction cavity so that a minimum of pumping work is done on the gas, said modulator ring operative to register in a second manner respectively with the housing port means of each bore upon rotation of said ring in one direction a predetermined angular distance to a second position, whereby said ring closes each of said port means so that said compressor pumps at maximum capacity, and said modulator ring operative to register in a third manner respectively with the housing port means of each bore upon rotation of said ring in the opposite direction through successive predetermined angular distances to a plurality of successive positions sequentially opening the housing port means one bore at a time so that the pumping capacity of said compressor is reduced by one compression chamber for each of the successive positions.

4. A radial compressor of the type including a cylinder housing having a unit axis and two pairs of cross bores including cylinder walls therein along axes normal to each other forming four compression chambers, the axes of said cylinder bores intersecting in a common transverse plane diametrical to said cross bores; a unitized assembly including a drive shaft on said unit axis rotatably mounted in the closed ends of said housing with said unit axis normal to said transverse plane at the intersection of said cross bore axes, said drive shaft assembly including a pair of piston assemblies, each said piston assembly including a double-ended piston slidable in each pair of cross bores, means forming inlet and outlet valves for said four compression chambers, means in said housing operatively related to the double-ended pistons to reciprocate the pistons in said cross bores as said shaft is rotated, said cylinder housing being formed to include suction and discharge cavities, wherein the improvement comprises a circular recess being formed in one end of said housing having a modulator port surface coaxial with said unit axis; each cylinder side wall having four housing port means therethrough for conveying gas from said bores to said suction cavity, said exhaust port means having their exits located in said modulator surface, a modulator ring being mounted in said recess for selectively opening and closing said exhaust port means by the rotary adjustment of the ring relative to said port means, means for rotating said ring in either direction to provide said rotary adjustment for controlling the effective output of said compressor, said modulator ring having four slots therein of progressively increasing arcuate lengths, such that the smallest and third largest are paired in substantially opposed relation for cooperation with a first pair of cross bores, and the second largest and largest are paired in substantially opposed relation for cooperation with the second pair of cross bores; and said four slots operative to register in one manner respectively with the housing port means of each bore upon rotation of said ring to a first position, whereby each of the housing port means is open allowing gas to flow from the compression chamber of each bore to said suction cavity so that a minimum of pumping work is done on the gas, said modulator ring slots operative to register in a second manner respectively with the housing port means of each bore upon rotation of said ring in one direction a predetermined angular distance to a second position, whereby said ring closes each of said port means so that said compressor pumps at maximum capacity, and said modulator ring slots operative to register in a third manner respectively with the housing port means of each bore upon rotation of said ring in the opposite direction through four successive predetermined angular distances to four successive positions sequentially opening the housing port means one bore at a time so that the pumping capacity of said compressor is reduced by one compression chamber for each of the four successive positions.

* * * * *